United States Patent [19]

Luton

[11] Patent Number: 4,601,650

[45] Date of Patent: Jul. 22, 1986

[54] EXTRUSION DIE FOR EXTRUDING METALLIC POWDER MATERIAL

[75] Inventor: Michael J. Luton, Summit, N.J.

[73] Assignee: Exxon Research and Engineering Co., Florham Park, N.J.

[21] Appl. No.: 729,744

[22] Filed: May 2, 1985

Related U.S. Application Data

[63] Continuation-in-part of Ser. No. 524,027, Aug. 17, 1983.

[51] Int. Cl.[4] ..... B22F 3/18

[52] U.S. Cl. ..... 425/79; 425/461

[58] Field of Search ..... 425/79, 461, 467

[56] References Cited

U.S. PATENT DOCUMENTS 2,783,499 3/1957 Billen ..... 425/79 X 4,420,294 12/1983 Lichtinghagen ..... 425/79

*Primary Examiner*—J. Howard Flint, Jr.

*Attorney, Agent, or Firm*—Henry E. Naylor

[57] ABSTRACT

Disclosed are extruded dispersion strengthened metallic materials which are substantially free of texture as well as a method for producing such materials. The method comprises extruding a billet of dispersion strengthened metallic powder material comprised of one or more metals and one or more refractory compounds said powder material having a mean grain size less than about 5 microns and whose grain size is substantially stable at the extrusion conditions, through a die having an internal contour such that the material is subjected to a natural strain rate which is substantially constant as it passes through the die.

2 Claims, 14 Drawing Figures

EXTRUSION DIE FOR EXTRUDING METALLIC POWDER MATERIAL

CROSS REFERENCE TO RELATED APPLICATIONS

This application is a continuation-in-part application of copending Ser. No. 524,027, filed Aug. 17, 1983.

The present invention relates to extrusion die for extruding fine grain dispersion strengthened metallic powder material wherein the extruded product is substantially free of texture.

BACKGROUND OF THE INVENTION

When metallic materials are extruded, the strain induced in the material is generally large, typically 2 to 4. When the metallic material is polycrystalline and is subjected to such large strains, it adopts a deformation texture wherein the grains of the material are oriented such that particular crystallographic directions are aligned parallel to the direction of working. Such textures can be modified by subsequent working and heat treatment, but the material rarely regains a random crystallite orientation. In as much as crystallite orientation is influential on both the directionality of the physical properties of bulk materials as well as the response to processes of microstructural modification, such as recrystallization and grain growth, there exists a need to develop methods for extruding metallic materials so the extruded product is substantially free of texture.

SUMMARY OF THE INVENTION

In accordance with the present invention there is provided an extrusion die capable of extruding fine grain dispersion strengthened metallic powder material wherein the resulting extruded product is substantially free of texture.

In preferred embodiments of the present invention the extruded product is comprised of (a) one or more metals selected from the high melting metals such as yttrium, silicon and those from Group 4b, 5b, 6b, and 8 or the low melting metals such as those from Groups 1b, 2b (excluding Hg), 3b 5a, 2a, 3a and 4a of the Periodic Table of the Elements, and (b) one or more refractory compounds selected from the group consisting of refractory oxides, carbides, nitrides, and borides. In still other preferred embodiments of the present invention the metal constituent is iron, nickel, or cobalt based and the refractory compound is yttria or $5Al_2O_3.3Y_2O_3$.

Such a die will have an internal contour such that the area of cross-section of the material as it is passing through the die conforms substantially to the formula:

$$A = \frac{A_o}{\left[1 + \frac{\dot{\epsilon}}{v} x\right]}$$

where

A is the area of cross-section at any point x along the major axis of the die orifice from its entry plane;

$A_o$ is the area of cross-section of the billet;

$\dot{\epsilon}$ is the true (or natural) strain rate; and v is the velocity of the ram of the extrusion press.

In one preferred embodiment of the present invention for producing the products hereof the material is extruded into a rod through a die whose internal contour substantially conforms to the formula:

$$R = \frac{1}{R^2} = \frac{1}{R_o^2} + Ax$$

where

R is the radius of the internal contour of the die at any given point x along the major axis of the die orifice from its entry plane;

$R_o$ is the radius of the billet; and

A is an arbitrary constant.

In another preferred embodiment the material is extruded into a tubular shape through a die whose internal contour conforms substantially to the formula:

$$\frac{1}{R^2} = \frac{(1 + Bx)}{(R_o^2 + R_m^2 Bx)}$$

where

R is the radius of the internal contour of the die at any given point x along the major axis of the die orifice from its entry plane;

$R_o$ is the radius of the billet;

$R_m$ is the radius of the mandrel; and

B is an arbitrary constant.

BRIEF DISCUSSION OF THE FIGURES

Figure 11B:
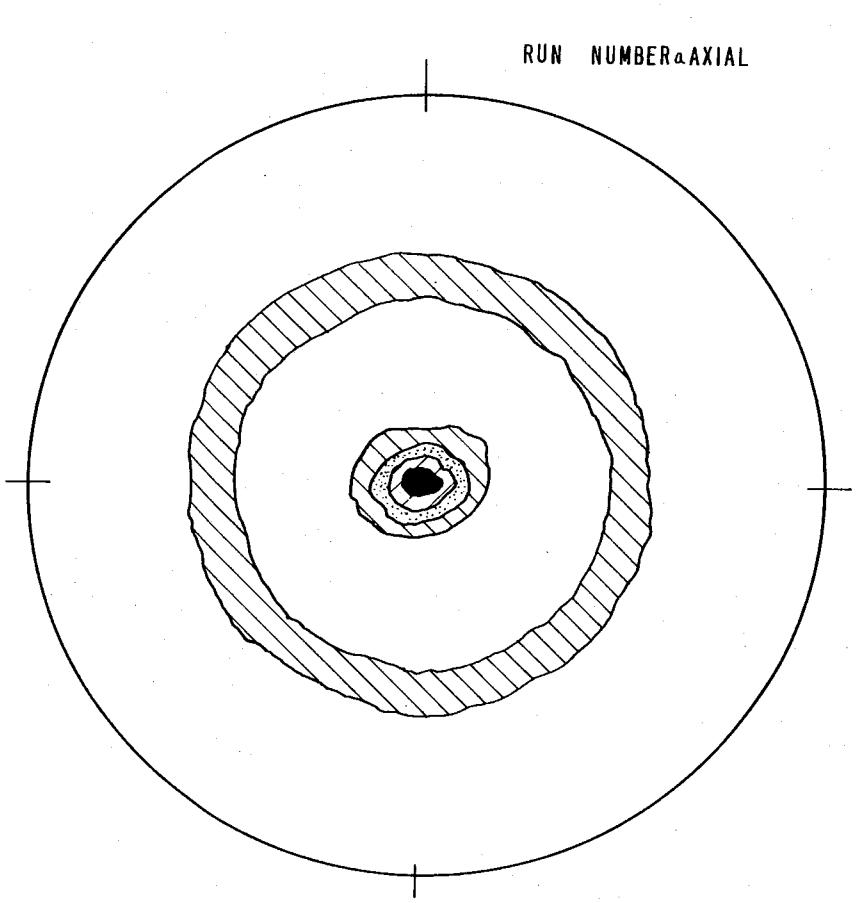
Figure 11A:
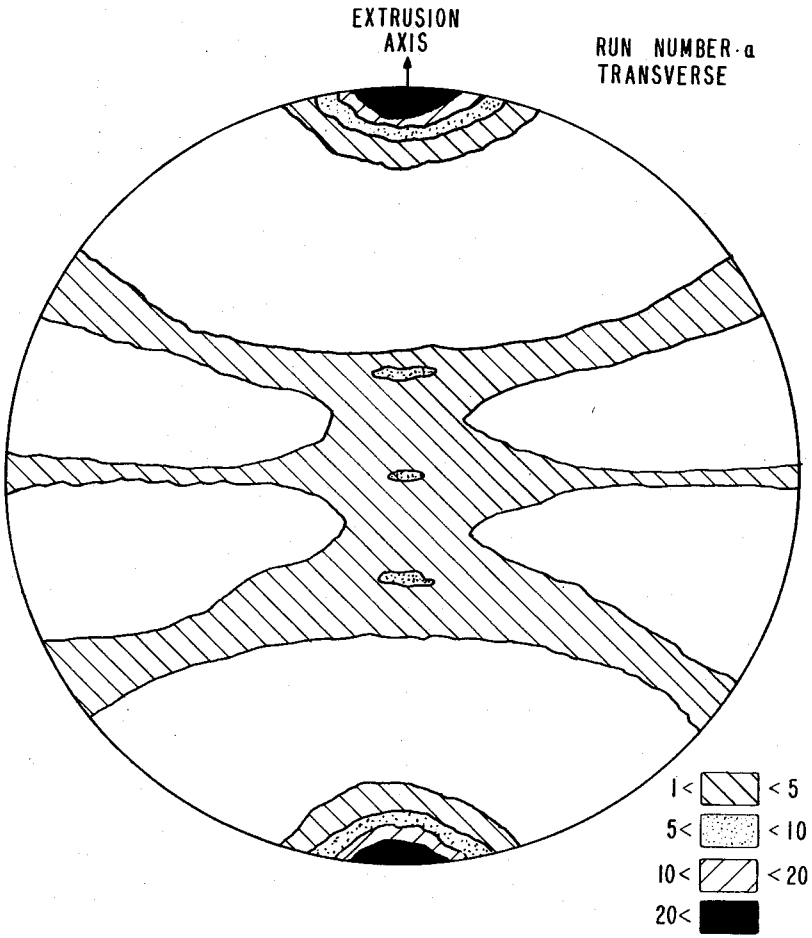

FIGS. 11*a* and *b* are standard <110> pole figures obtained on MA956 having a grain size of about 2 mm and extruded through a die for extruding rods in accordance with the present invention, at a rate of 250 mm/sec after being preheated to 1270° C. FIG. 11*a* was obtained from a section of the material cut parallel (transverse plane) to the extrusion axis. FIG. 11*b* was obtained from a section cut perpendicular (axial plane) to the extrusion axis.

Figure 12B:
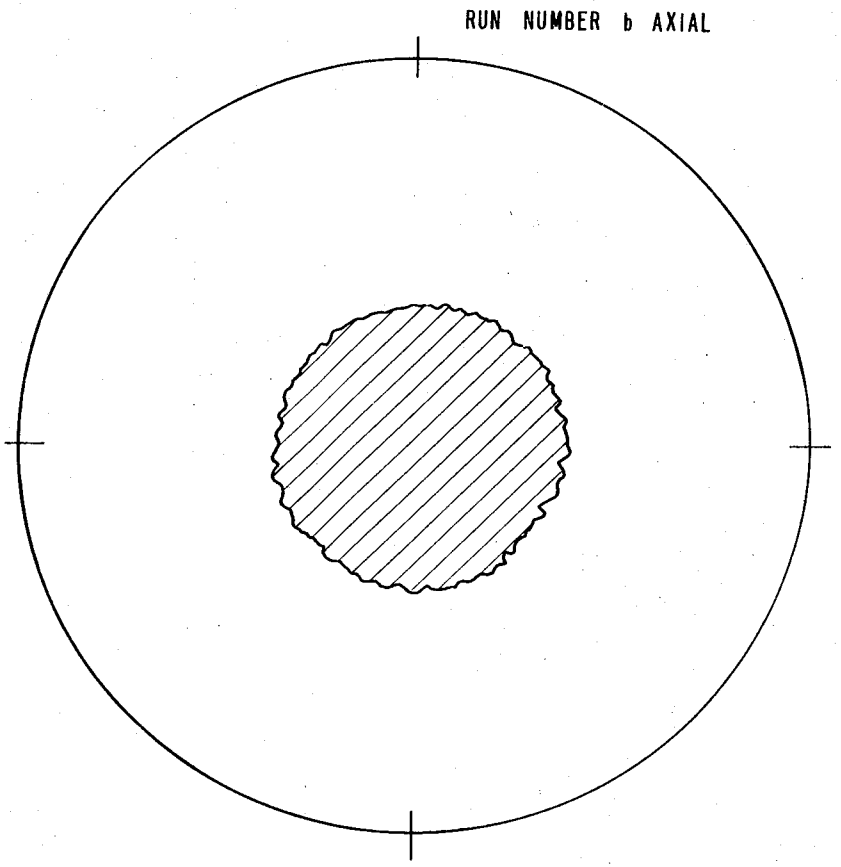
Figure 12A:
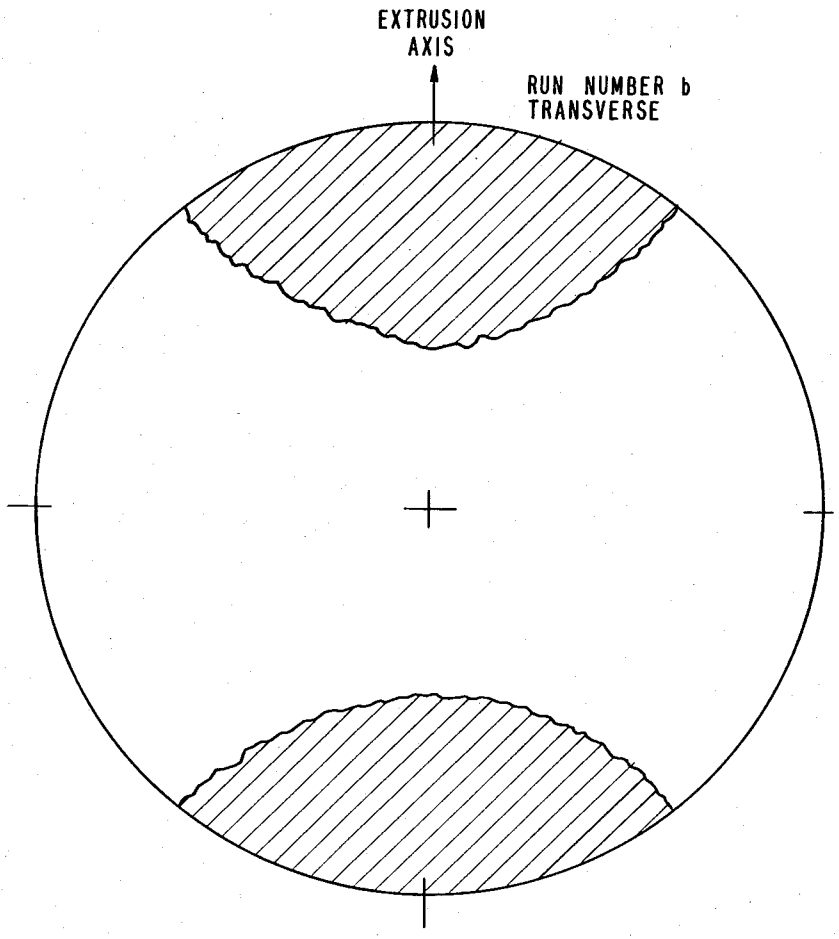

FIGS. 12*a* and *b* are a standard <110> pole figures obtained on MA956 material having a mean grain size of about 2 m and extruded through a die for extruding rods in accordance with the present invention, at a rate of 75 mm/sec after being preheated to 1270° C. FIG. 12*a* was obtained from a section of the material cut parallel to the extrusion axis and FIG. 12*b* was obtained from a section cut perpendicular to the extrusion axis.

DETAILED DESCRIPTION OF THE INVENTION

Metallic materials which are preferably extruded through the die of the present invention are fine grain dispersion strengthened materials which are prepared by powder metallurgical techniques and which have a substantially uniform mean grain size of less than about 5 microns, preferably less than about 2 microns, more preferably less than about 1 micron. For purposes of the present invention, there is no restriction as to the type of metallic material or powder metallurgy technique used to produce the powders employed herein, as long as the material has a mean grain size of less than about 5 microns and the grain size is substantially stable at the extrusion temperature employed herein. The precise grain size required herein is a function of the material extruded and can be easily determined by one having ordinary skill in the art given the teaching herein.

A consequence of powder metallurgy processing for the production of bulk material is that after consolidation, the mean grain size of the material can sometimes be induced to be less than about 5 or even 2 microns. Such fine grain materials have a "window" of strain rate and temperature wherein the material responds with enhanced plasticity to the imposition of strain. That is, the material is capable of sustaining relatively large elongations (greater than 100%) in tension and the ability to flow plastically at a much lower stress level, than for the same material having coarse grains, within the same strain-rate temperature window. Although not wishing to be limited by theory, I believe this condition results from the high strain-rate sensitivity of the micromechanisms of flow in the fine grain material, thereby promoting plastic stability. The micromechanisms of flow also promote a random orientation of individual grains within the material so that no significant deformation texture is developed. This has the affect of promoting isotropic physical properties. The high strain-rate sensitivity under such conditions also promotes uniformity of flow in constrained deformation such as extrusion, drawing, and closed-die forging.

Unfortunately, the strain-rate temperature window for such materials, even the fine grain materials, is very narrow. During extrusion with conventional conical or flat dies, the strain-rate varies continuously by up to two or more orders of magnitude as the material passes through the die. As a result, it is not possible to extrude such materials with such conventional dies under the conditions required for enhanced plasticity because the strain-rate cannot be maintained sufficiently constant at the temperature of extrusion.

By using the dies of the present invention, such materials may be extruded such that the extruded product is substantially free of texture. The term substantially free of texture as used herein means the extruded material is substantially free of preferred crystallographic orientation. Another way of expressing this is that when a pole figure is obtained from the material which is substantially free of texture, no region of the pole figure would show a pole density greater than about 10 times that which would be obtained from a randomly oriented sample, more preferably no more than about 5 times, and most preferably no more than about 3 times. This renders the material isotropic, that is, having substantially the same mechanical and physical properties in all directions. It is possible to obtain such material by the practice of the present invention because the internal contour of the die is such that it changes continuously in the die zone in such a manner as to cause the material being extruded through the die to conform substantially to the formula:

$$A = \frac{A_o}{\left[1 + \frac{\dot{\epsilon}}{v} x\right]}$$

where

A is the area of cross-section at any given point x along the major axis of the die orifice from the entry plane of the die;

$A_o$ is the area cross-section of the billet;

$\dot{\epsilon}$ is the true (or natural) strain rate; and v is the velocity of the ram of the extrusion press.

Types of metallic materials which are of interest in the practice of the present invention are the dispersion strengthened materials wherein a hard phase is present with one or more metals. Preferred are alloys containing two or more metals. The term dispersion strengthened alloys, as used herein, means those alloys in which metallic powders are strengthened with hard phases, sometimes hereinafter referred to as dispersoid or dispersoid phase, such as refractory oxides, carbides, nitrides, borides, and the like.

The dispersoid of the dispersion strengthened alloys which may be extruded in accordance with the present invention may be refractory oxides, carbides, nitrides, borides, and the like, of such refractory metals as thorium, zirconium, hafnium, titanium. Refractory oxides suitable for use herein are generally oxides of those metals whose negative free energy of formation of the oxide per gram atom of oxygen at about 25° C. is at least about 90,000 calories and whose melting point is at least about 1300° C. Such oxides, other than those listed above, include oxides of silicon, aluminum, yttrium, cerium, uranium, magnesium, calcium, beryllium, and the like. Also included are the following mixed oxides of aluminum and yttrium: $Al_2O_3.2Y_2O_3$ (YAP), $Al_2O_3.Y_2O_3$ (YAM), and $5Al_2O_3.3Y_2O_3$ (YAG). Preferred oxides include thoria, yttria, and (YAG), more preferred are yttria and YAG, and most preferred is YAG.

The amount of dispersoid employed herein need only be such that it furnishes the desired strength characteristics in a given alloy product. Increasing amounts of dispersoid generally provide increasing strength but continually increasing amounts may lead to decreasing strength. Generally, the amount of dispersoid employed may range from about 0.5 to 25 vol.%, preferably about 0.5 to 10 vol.%, more preferably about 0.5 to 5 vol.%.

Although the materials extruded herein may contain one or more of any metal, it is preferred that they contain at least one metal selected from the high melting metals such as yttria, silicon and those from Groups 4b, 5b, 6b, and 8 or the lower melting metals such as those from Groups 1b, 2b (excluding Hg), 3b, 5a, 2a, 3a, and 4a of the Periodic Table of the Elements. Preferred is Groups 8 and 3a, more preferred are iron, nickel, and aluminum. The Periodic Table of the Elements referred to herein is the table shown on the inside cover of *The Handbook of Chemistry and Physics,* 65th Edition (1984–1985), CRC Press. Alloys of particular interest for the practice of the present invention are the high temperature alloys containing, by weight, up to 65%, preferably about 5% to 30% chromium; up to 8%, preferably about 0.5% to 6.5% aluminum; up to about 8%, preferably about 0.5% to 6.5% titanium; up to about 40% molybdenum; up to about 20% niobium; up to about 30% tantalum; up to about 40% copper; up to about 2% vanadium, up to about 15% manganese; up to about 2% carbon, up to about 1% silicon, up to about 1% boron; up to about 2% zirconium; up to about 0.5% magnesium; and the balance being one or more of the metals selected from the group consisting of iron, nickel and cobalt in an amount being at least about 25%.

Non-limiting examples of methods for producing the dispersion strengthened metal powders include atomization, chemical reduction, mechanical crushing, electrolysis, and rapid solidification techniques. The resulting powders can then be alloyed by any one of the following alloying techniques: (a) mechanical alloying wherein metal powders and dispersoid particles are blended and deformed by mechanical energy such as ball milling to achieve a distribution of constituents within each individual composite powder particle; (b) infiltration, wherein a liquid of one composition is caused to penetrate the pores of a compact of a different composition; (c) the reduction of finely divided oxide particles to achieve a relatively homogeneous alloy powder. After subsequent heat treatment of the alloyed material, the microstructure of the individual composite powder particles suitable for use herein must be composed of individual grains having a mean grain size of less than about 5 microns.

A preferred method of preparing the alloy material for extruding in accordance with the present invention is the cryogenic milling procedure taught in co-pending U.S. Ser. No. 729,742 filed May 2, 1985, and incorporated herein by reference.

The resulting substantially homogeneous composite powder is then formed into billets by any appropriate conventional means. The billet is then hot-worked by such techniques as forging, upsetting, rolling, or hot isostatic pressing to consolidate the powder prior to extrusion.

Figure 1:
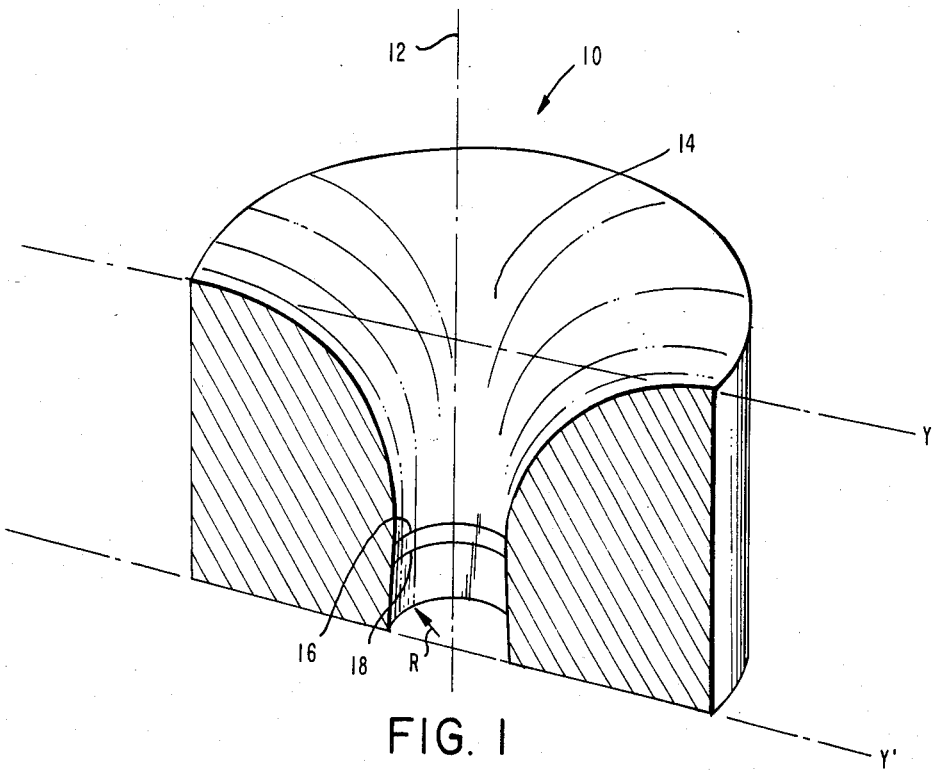
FIG. 1 is a perspective sectional view of a die used to extrude rods in accordance with the present invention.
Figure 2:
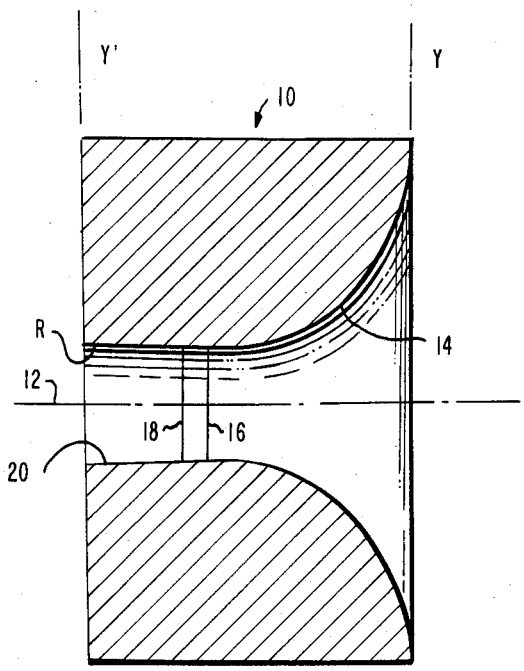
FIG. 2 is a cross-sectional view of a die used in the present invention for extruding rods wherein the internal contour of the die is illustrated.
Figure 3:
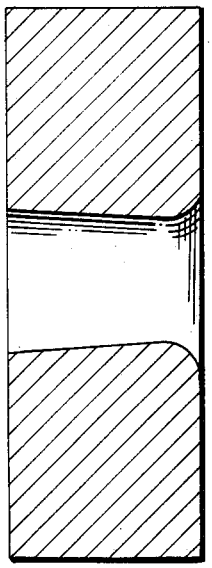
PRIOR ART FIG. 3
FIG. 3 is a cross-sectional view of a prior art die which is conventionally used to extrude metallic powder material into rods.

FIG. 1 hereof shows a perspective sectional view of a die for extruding rods of the present invention at 10 and FIG. 2 shows a cross-sectional view of the same die. The contour of the internal passageway 14 substantially conforms to the formula $$\frac{1}{R^2} = \frac{1}{R_o} + Ax$$

(i) For a given desired extrusion ratio, E, where E is equal to the ratio of the area of cross section of the billet to the area of cross-section of the extruded rod, the length L, of the converging die channel is given by:

$$L = \frac{(E-1)}{A\,R_o^2}$$

(ii) For a given ram velocity, v, the true strain rate imposed on the material, passing through the die is given by:

$$\gamma = AvR_o^2$$

whose variables have been previously identified herein. The radius R of the die orifice, or passageway, is indicated at any given point x along the major axis 12 of the die orifice from entry plane Y. The die includes an entry orifice at entry plane Y where the radius of the die orifice is at a maximum. The die profile 14, sometimes also referred to herein as the internal contour of the die, converges in accordance with the above formula and terminates at some distance along the major axis as indicated at 16. The die orifice may then contain a small parallel section between 16 and 18 which section, if present, should be kept to a minimum length to minimize the friction of the extruding material along the internal walls of the die orifice. From 18 of the exit plane Y', the radius of the internal contour of the die increases slightly 20 to allow for breakaway of the extruded product from the die. This breakaway section of the die is conventional and its upper limit is usually set by the die support system. Although the actual degree of breakaway is conventional and can be easily calculated by one have ordinary skill in the art for any given die system, it will usually have a lower limit of about 3 degrees.

Figure 4:
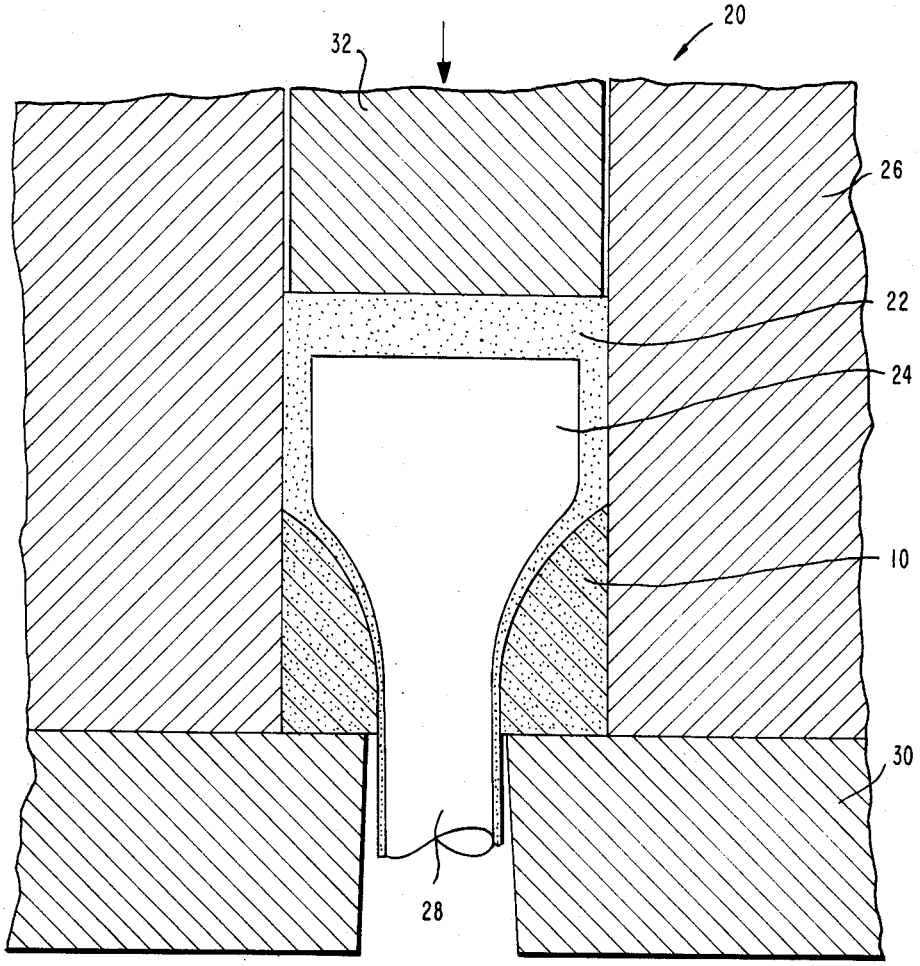
FIG. 4 shows a partial cross-sectional view of an extrusion apparatus for extruding rods in accordance with the present invention.

FIG. 4 hereof is a partial cross-sectional view of an extrusion apparatus at 20 for extruding rods in accordance with the present invention. In general, the present invention is practiced by placing a heated billet comprised of fine grain dispersion strengthened powder material 24 in a can 22 into the container 26 of an extrusion press. The billet may be prepared by first loading a billet-can with fine grain dispersion strengthened powder material. The billet-can may be comprised of any suitable material commonly used for such purposes, such as plain carbon steel or the like. The billet is coated with conventional lubricant, such as glass, and a conventional lubricant pad is placed between the billet and the die. It may be preferred that the billet have an elongated section at its front end so that it fits snugly into the die orifice to prevent loss of lubricant prior to extrusion. The billet is then extruded by causing the ram 32 to move in the forward direction at a predetermined velocity which causes the billet to extrude at a constant natural strain rate into a rod 28 through the die 10 whose exit plane rests up against shear plate 30 of the extrusion press. The particular temperature and strain-rate required for any given material to be extruded with enhanced plasticity so as to produce a product substantially free of texture, can be determined by first measuring the strain rate sensitivity of the material by such conventional techniques as tensile tests, compression tests, or torsion tests. A combination of temperature and strain-rate is then calculated which would give a strain rate sensitivity in excess of about 0.4. The procedure used herein for determining criteria for any given dispersion strengthened material will be discussed in detail in a following section hereof.

Figure 5:
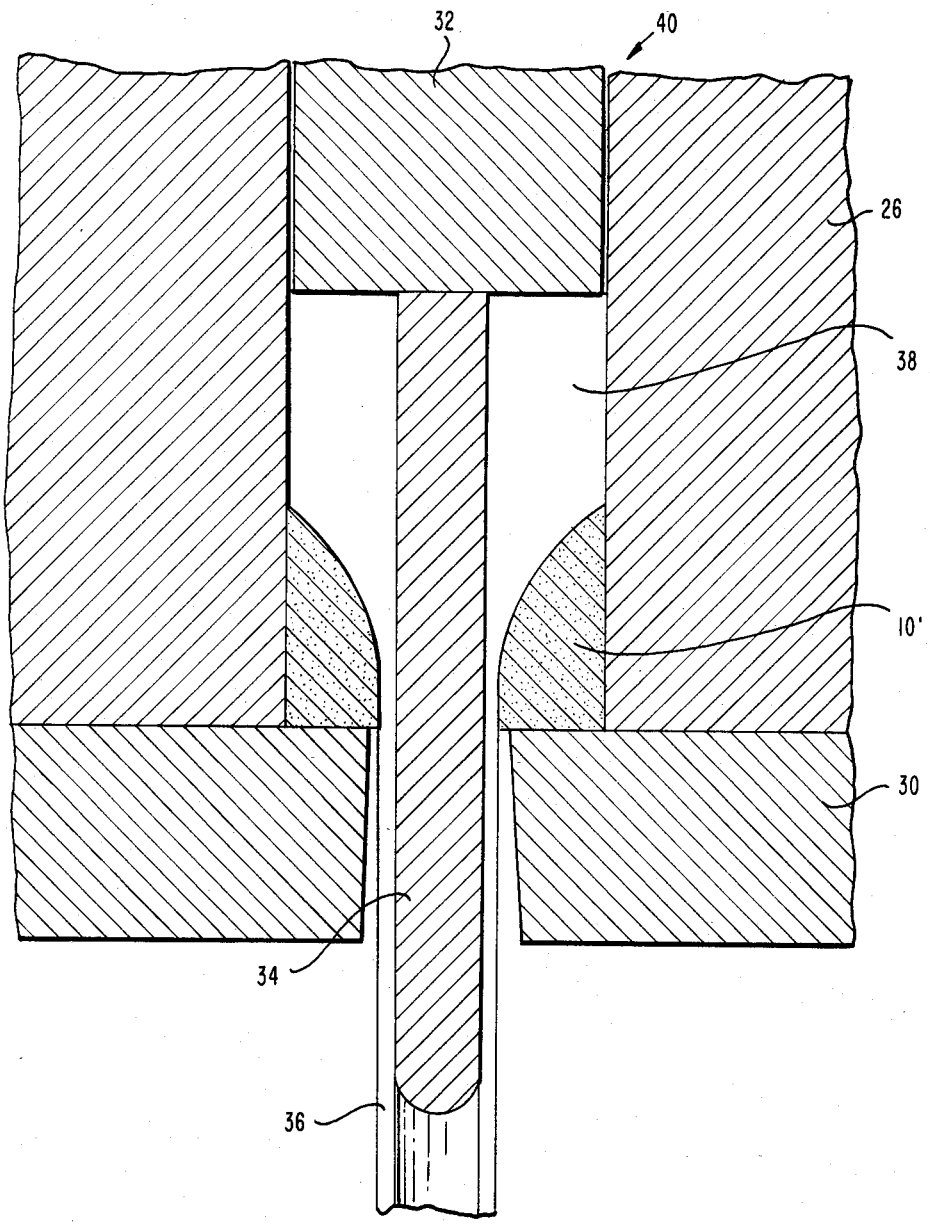
FIG. 5 is a partial cross-sectional view of an extrusion apparatus for extruding tubes in accordance with the present invention.

FIG. 5 hereof is a partial cross-sectional view of an apparatus 40 for extruding tubes in accordance with the present invention is shown. As in FIG. 4, 26 is the container of the extrusion press, 30 is the shear plate and 32 is the ram. After loading the billet-can, it is closed at its backend with a cap which is welded into place. The cap contains a metal tube through its center which is used to evacuate the can. After evacuation the tube is crimped and its end welded to produce an air tight seal. The billet is then upset in an extrusion press to consolidate the powder material prior to extrusion. This procedure is used for all extrusions except if the billet is to be used to produce tubes, the consolidated powder material may be removed from the can and a hole drilled, or pierced, through its center from one end to the other to allow for passage of the mandrel 34 which is attached to the ram 32. The die 10' used to extrude the fine grain composite material into tubes 36 must have an internal contour which substantially conforms to the formula $$\frac{1}{R^2} = \frac{(1 + Bx)}{(R_o^2 + R_m^2 Bx)}$$

(i) For a given desired extrusion ration, E, the ratio of the area of cross-section of the P billet to the cross-section area of the extruded tube wall, the length, L, of the converging channel is given by:

$$L = \frac{(E - 1)}{B}$$

(ii) For a given ram velocity, v, the true straiin rate imposed on the material, passing through the die, is given by:

$$= B$$

whose variables have been previously defined.

The ram velocity will generally be in the range of about 10 to about 100 mm/sec. The billet is then extruded, in the presence of a lubricant, at a constant natural strain-rate to cause the material to exhibit enhanced plasticity during extrusion. The particular temperature and strain-rate required for any given material to obtain the condition of enhanced plasticity can be determined by first measuring the strain rate sensitivity of the material by such conventional techniques as tensile tests, compression tests, or torsion tests. A combination of temperature and strain-rate is then calculated which would give a strain rate sensitivity in excess of about 0.4 when the mean grain size of the material is less than about 5 microns.

Although not wishing to be limited hereby, one method which may be used to determine the strain-rate sensitivity for any particular material would be to perform tensile tests on samples at various temperatures and at various predetermined initial strain rates, such as between $10^{-3}$ and 1 $s^{-1}$. The logarithms of the strain rates are plotted versus the flow stress for a given grain size. The strain rate sensitivity is determined from the slope of such a plot for each test temperature.

The following examples serve to more fully describe the present invention. It is understood that these examples in no way serve to limit the true scope of this invention, but rather, are presented for illustrative purposes.

ILLUSTRATION OF SELECTING CRITERIA FOR EXTRUSION FOR ANY GIVEN MATERIAL

To illustrate a method for determining strain rate sensitivity for any given material, cylindrical samples from two different iron base oxide dispersion strengthened MA956 bar stock samples were prepared. One MA956 bar stock had a mean grain size of about 1 micron and the other had a mean grain size of about 8 microns. Each sample had an actual diameter of ¼ inch and an overall length of 1½ inches with a gauge diameter of ⅛ inch and a gauge length of ½ inch. Tensile test were performed on the samples at temperatures of 1050° C., 1100° C., 1150° C., and 1200° C. at strain rates between $10^{-4}$ and $10^{-1}$ $s^{-1}$ on an MTS servohydraulic test system which was programmed to deliver a constant natural strain rate during uniform elongation of the sample. Flow stress was measured throughout each test and the maximum value of this stress for both the 1 micron samples and 8 micron samples are shown in Tables I and II below. MA956 employed herein is a yttria strengthened iron base high temperature alloy available from INCO and having the following chemical analysis in weight percent based on the total weight of the alloy: 73.1 Fe, 20.69 Cr, 5.09 Al, 0.32 Ti, 0.02 C, 0.02 S, and 0.76 $Y_2O_3$.

TABLE I

1 MICRON GRAIN SIZE MA956

| T °C. | Strain Rate (/s) | Max. Stress (MPa) |
|---|---|---|
| 1050 | $9 \times 10^{-5}$ | 17.0 |
| 1050 | $3 \times 10^{-4}$ | 19.5 |
| 1050 | $5 \times 10^{-4}$ | 24.4 |
| 1050 | $1 \times 10^{-3}$ | 36.0 |
| 1050 | $3 \times 10^{-3}$ | 48.9 |
| 1050 | $8 \times 10^{-3}$ | 65.8 |
| 1050 | $1 \times 10^{-2}$ | 59.7 |
| 1050 | $3 \times 10^{-2}$ | 64.6 |
| 1050 | $1 \times 10^{-1}$ | 68.2 |
| 1100 | $5 \times 10^{-4}$ | 18.0 |
| 1100 | $1 \times 10^{-3}$ | 21.7 |
| 1100 | $3 \times 10^{-3}$ | 29.0 |
| 1100 | $5 \times 10^{-3}$ | 41.6 |
| 1100 | $1 \times 10^{-2}$ | 51.5 |
| 1100 | $3 \times 10^{-2}$ | 60.0 |
| 1100 | $1 \times 10^{-2}$ | 65.0 |
| 1150 | $3 \times 10^{-4}$ | 16.2 |
| 1105 | $1 \times 10^{-3}$ | 17.0 |
| 1150 | $3 \times 10^{-3}$ | 20.0 |
| 1150 | $1 \times 10^{-2}$ | 26.8 |
| 1150 | $3 \times 10^{-2}$ | 36.9 |
| 1150 | $5 \times 10^{-2}$ | 49.5 |
| 1150 | $1 \times 10^{-1}$ | 56.6 |
| 1200 | $3 \times 10^{-3}$ | 17.0 |
| 1200 | $1 \times 10^{-2}$ | 18.0 |
| 1200 | $2 \times 10^{-2}$ | 20.5 |
| 1200 | $4 \times 10^{-2}$ | 26.0 |
| 1200 | $9 \times 10^{-2}$ | 31.5 |
| 1200 | $1.3 \times 10^{-1}$ | 45.1 |

TABLE II

8 MICRON GRAIN SIZE MA956

| T °C. | Strain Rate (/s) | Max. Stress (MPa) |
|---|---|---|
| 1100 | $1 \times 10^{-5}$ | 16.6 |
| 1100 | $2 \times 10^{-5}$ | 20.5 |
| 1100 | $6 \times 10^{-5}$ | 29.0 |
| 1100 | $1 \times 10^{-5}$ | 40.0 |
| 1100 | $3 \times 10^{-4}$ | 52.2 |
| 1100 | $1 \times 10^{-3}$ | 60.5 |
| 1100 | $2 \times 10^{-3}$ | 66.4 |
| 1150 | $2 \times 10^{-5}$ | 17.0 |
| 1150 | $1 \times 10^{-4}$ | 20.0 |
| 1150 | $3 \times 10^{-4}$ | 30.6 |
| 1150 | $1 \times 10^{-3}$ | 48.2 |
| 1150 | $2 \times 10^{-3}$ | 55.8 |
| 1200 | $1 \times 10^{-4}$ | 17.5 |
| 1200 | $3 \times 10^{-4}$ | 19.0 |
| 1200 | $1 \times 10^{-3}$ | 27.6 |
| 1200 | $2 \times 10^{-3}$ | 44.5 |
| 1200 | $3 \times 10^{-3}$ | 5.00 |
| 1200 | $5 \times 10^{-3}$ | 62.1 |

Figure 6:
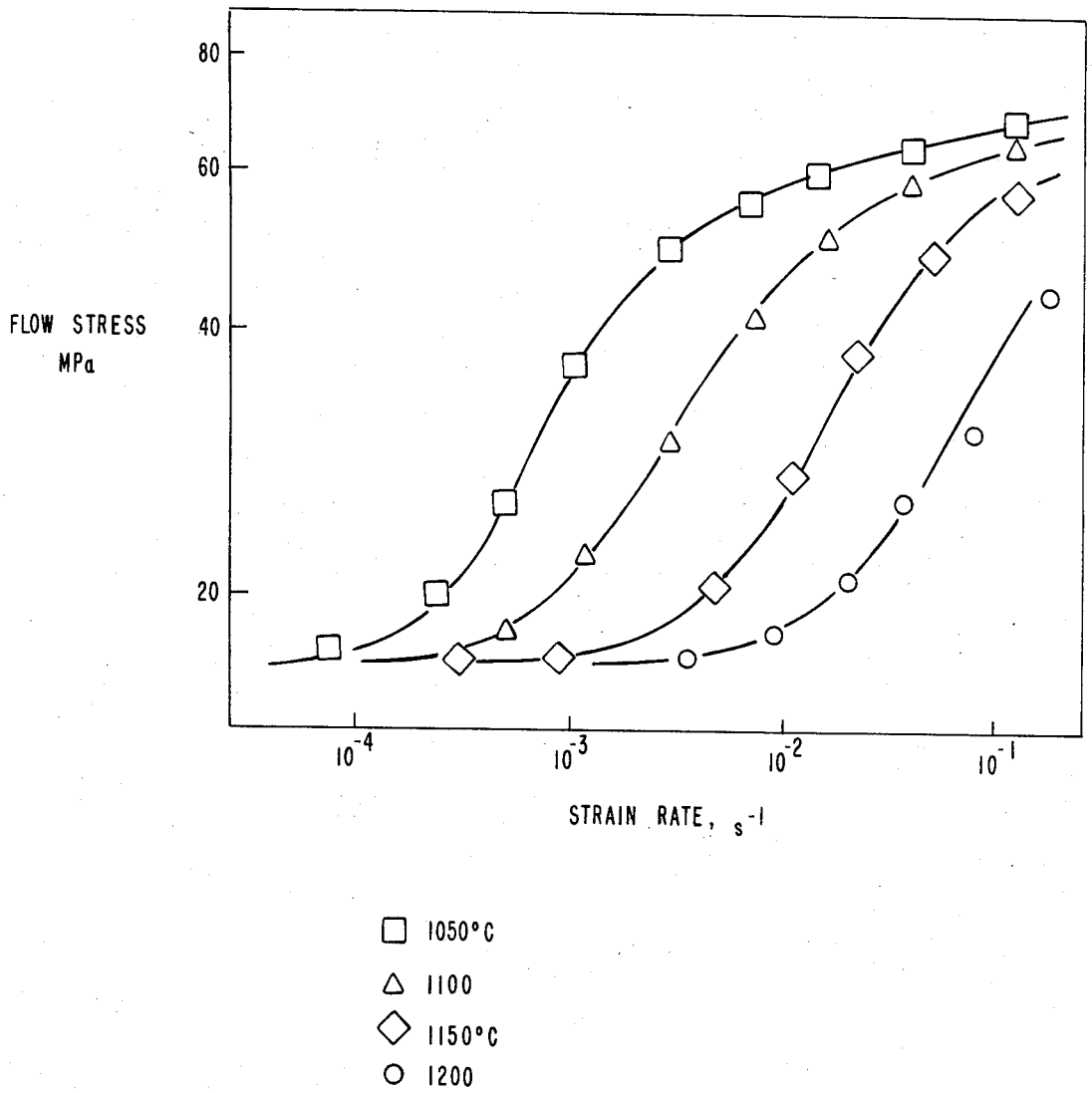
FIG. 6 is a logarithmic plot of flow stress versus strain rate at various temperatures for an iron base oxide dispersion strengthened alloy designated MA956 and having a mean grain size of about one micron.
Figure 7:
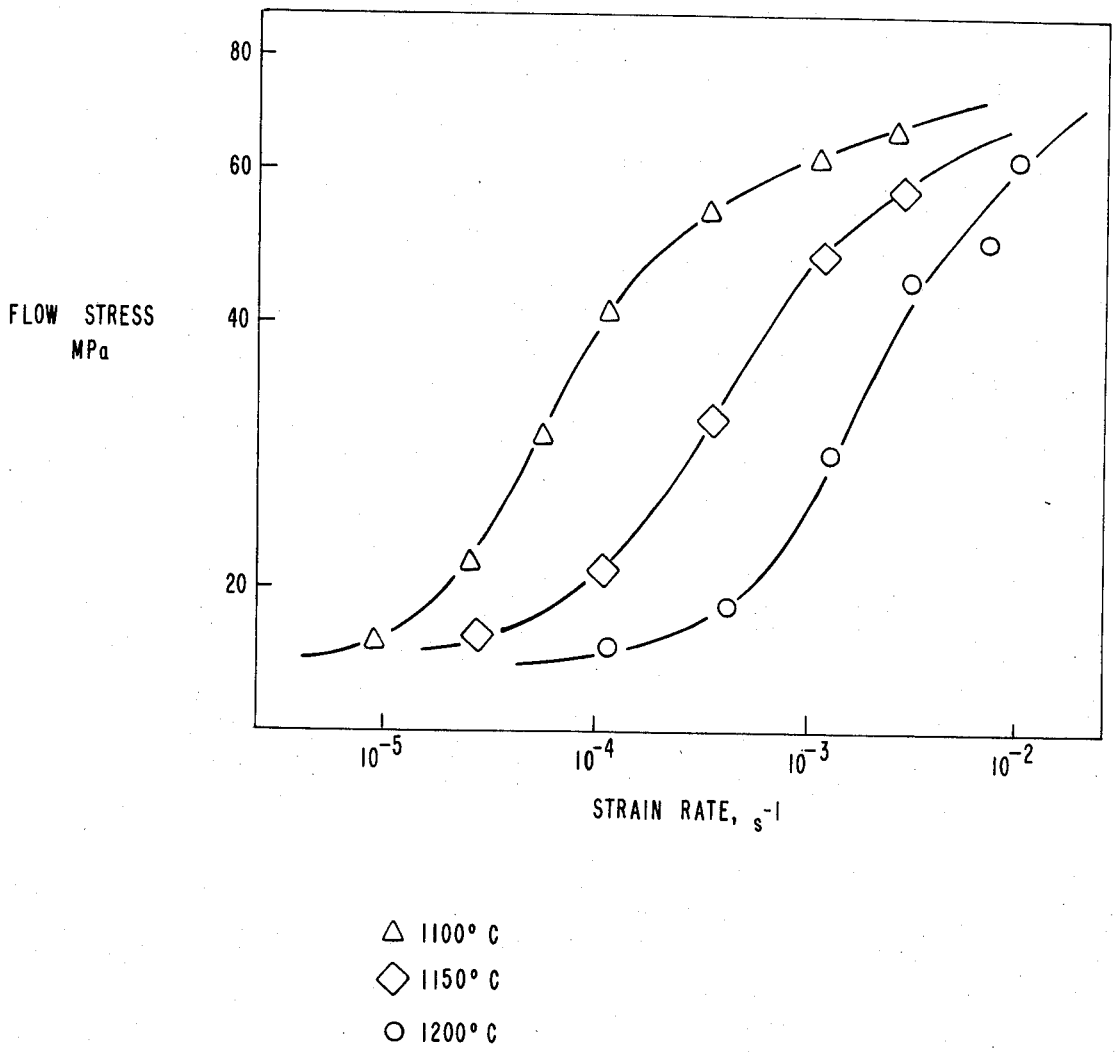
FIG. 7 is a logarithmic plot of flow stress versus strain rate at various temperatures for an iron base oxide dispersion strengthened alloy designate MA956 having a mean grain size of about eight microns.
Figure 8:
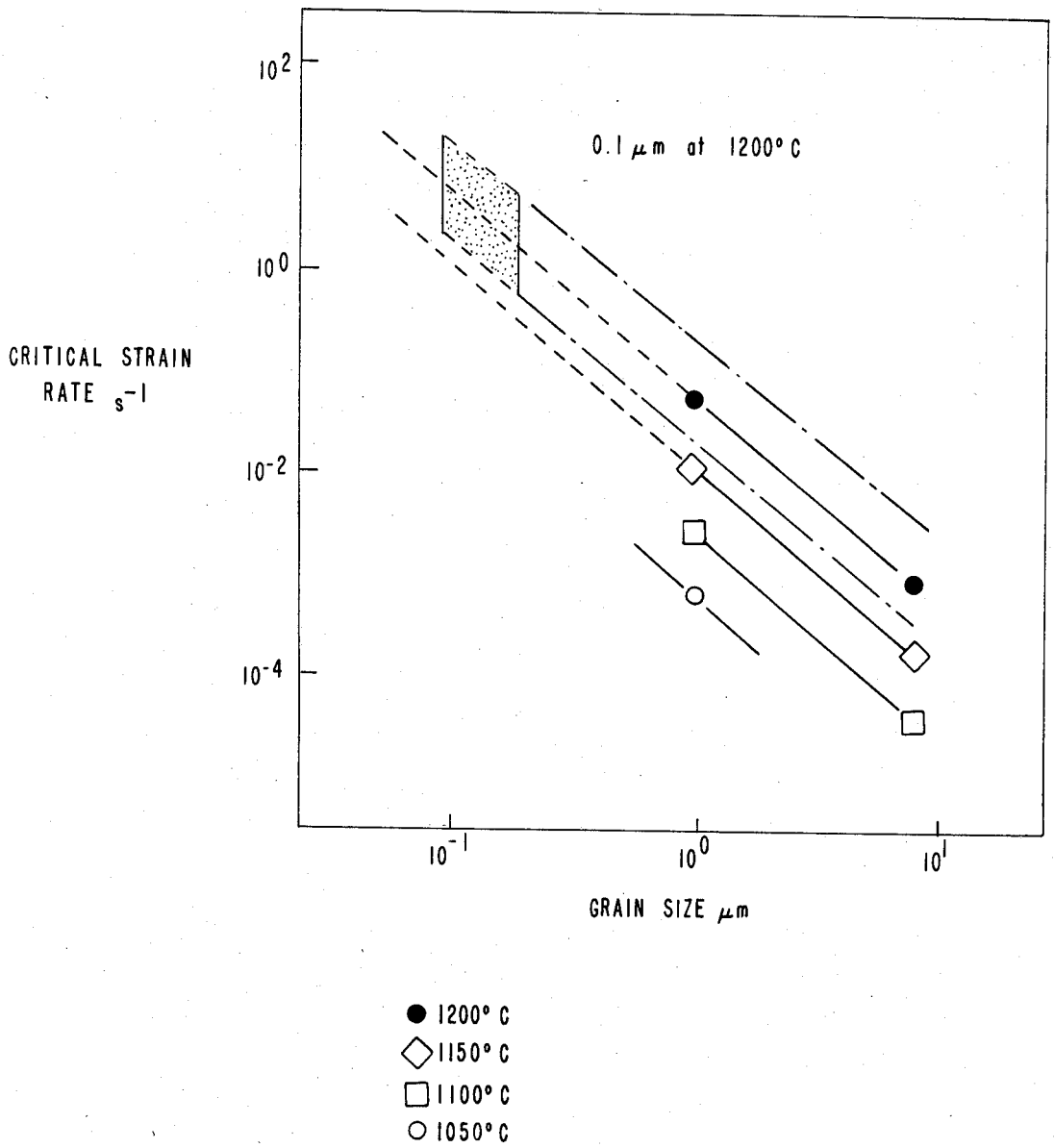
FIG. 8 is a logarithmic plot of the critical strain rate versus grain size for MA956 material.

A plot of the data of Table I and II above are shown in FIGS. 6 and 7 herein respectively. The critical strain rate range is shown for a given temperature and grain size by the portion of the curve having maximum slope (strain rate sensitivity). In FIG. 8 hereof the critical strain rate is plotted against grain size for each temperature. Extrapolation of these curves to strain rates obtained during extrusion reveals the required grain size needed for the practice of the present invention.

Figure 9:
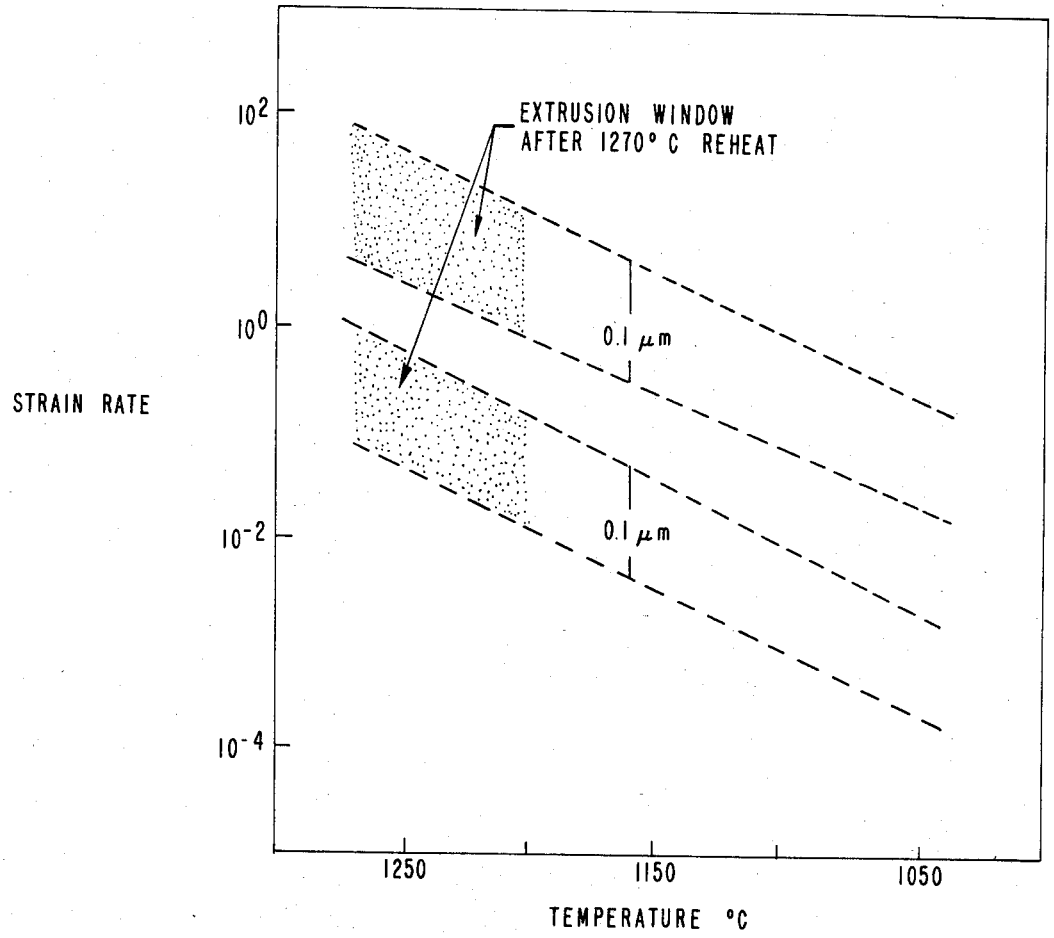
FIG. 9 is a logarithmic plot of the critical strain rate versus temperature for MA956 material which illustrates how the critical strain rate and temperature can be set for any given grain size material.
Figure 10:
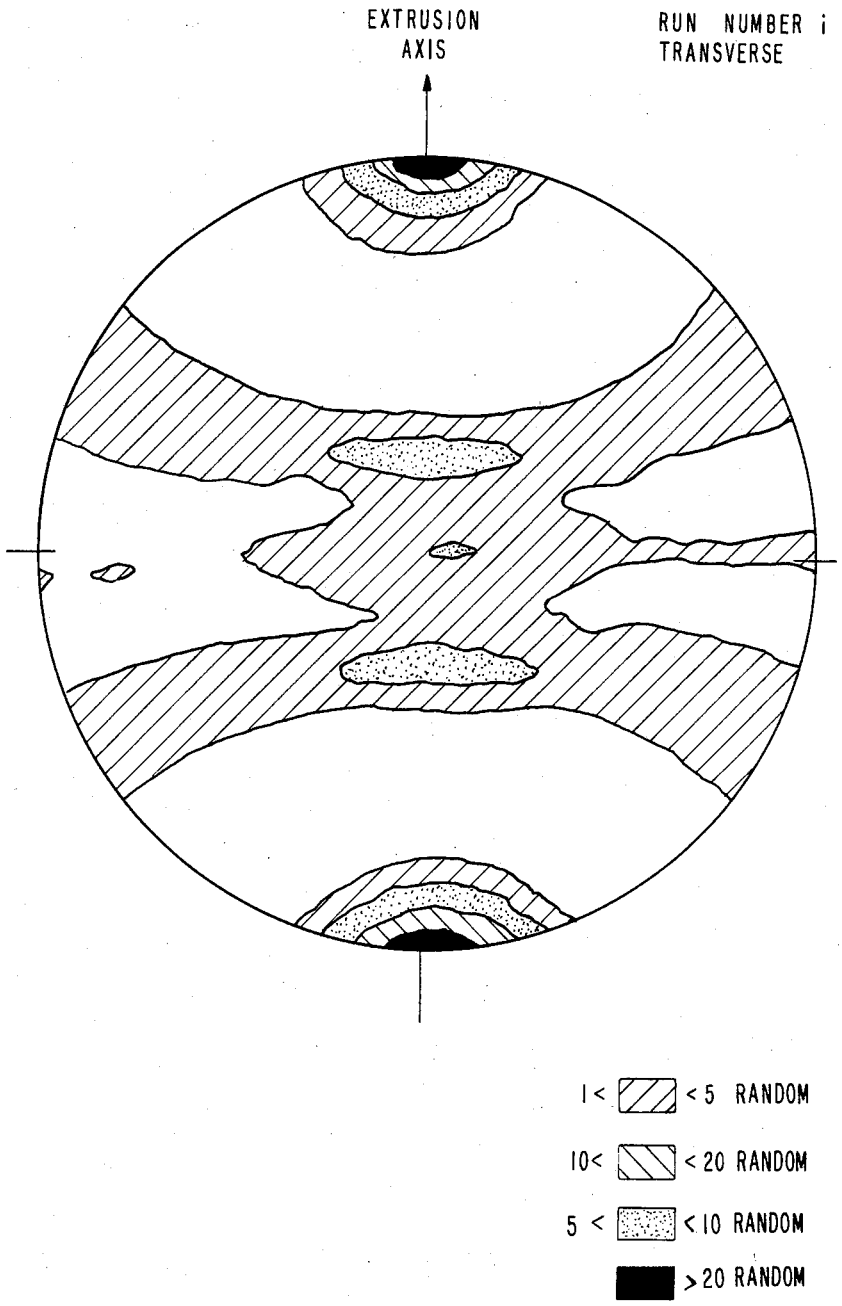
FIG. 10 is a standard <110> pole figure obtained on MA956 having a mean grain size of about 2 μm and extruded through a prior art die at a rate of 75 mm/sec after being preheated to 1270° C.

Alternatively, a plot of the form of FIG. 9 hereof can be used to set the temperature and strain rate conditions for extrusion for a given grain size material.

EXAMPLES

Billets about 8.5 inches long and about 2.4 inches in diameter were prepared by charging plain carbon steel billet-cans with a composite metal powder mixture prepared from a master batch consisting of 300 g Cr, 67.5 g Al, 15 g Ti, 7.5 g $Y_2O_3$, and 1110 g Fe. The mean grain size of the grains within the powder particles was about 0.5 microns. The charge was packed by cold pressing at 20 tons. The billets were then capped and welded except for a tube which extended out of the back of each billet for evacuation purposes. The billets were evacuated to about $10^{-4}$ mmHg whereupon the tubes were pinched off at the billets and welded. Each billet was placed in a furnace and heated to the preheat temperature set forth in Table III below. Each billet was removed from the furnace and rolled in Fummite, a glass lubricant. A glass lubricant pad was placed in the container of the extrusion press before each extrusion and the container, pad, and die were heated to about 310° C. For each extrusion, the preheated billet was placed into the container of the extrusion press and extruded at the rate and with the die shown in Table III below.

Each extruded sample was then analyzed for texture by use of a Rigaku DMAX-II-4 diffractometer using an automatic pole figure device. Data were collected for the <110> reflection. The Decker method was employed in transmission and the Schultz method in reflection so that the entire pole figure could be obtained. (R. D. Cullity, "Elements of X-ray Diffraction", Addison-Wesley, Reading, MA, 1967, pp. 285–295). As shown in Table III below, most extruded samples exhibited strong texture except run 6 which was extruded in accordance with the present invention and was substantially free of texture.

TABLE III

| DIE OF PRESENT INVENTION[1] | | | | CONVENTIONAL DIE | | | |
|---|---|---|---|---|---|---|---|
| Run | Preheat Temp. | Extrusion Rate | Texture[2] (times random) | Run | Preheat Temp. | Extrusion Rate | Texture[2] (times random) |
| a. | 1270° C. | 250 mm/s | (s) >16 | i. | 1270° C. | 75 mm/s | (vs) >25 |
| b. | 1270° C. | 75 mm/s | (vw) <5 | j. | 1170° C. | 75 mm/s | — |
| c. | 1270° C. | 16 mm/s | (s) >16 | k. | 1070° C. | 75 mm/s | — |
| d. | 1170° C. | 250 mm/s | — | | | | |
| e. | 1170° C. | 75 mm/s | (s) >20 | | | | |
| f. | 1170° C. | 16 mm/s | — | | | | |
| g. | 1070° C. | 250 mm/s | — | | | | |
| h. | 1070° C. | 75 mm/s | — | | | | |

[1]die having an internal contour conforming substantially to the formula:

$$\frac{1}{R^2} = \frac{1}{R_o^2} + Ax$$

R = radius of die contour at a given point x along the major axis of the die orifice from the entry plane Y;
$R_o$ = radius of billet,
A = an arbitrary constant
[2]the value under texture indicates maximum pole density on a pole figure in terms of the pole density observed in a randomly oriented sample obtained from the corresponding extruded sample.
s = strong,
vs = very strong,
vw = very weak

What is claimed is:

1. An extrusion die for extruding rods from metallic powder materials wherein the internal contour of the die conforms substantially to the formula:

$$\frac{1}{R^2} = \frac{1}{R_o^2} + Ax$$

where R is the radius of the die contour at any given point x along the major axis of the die orifice from its entry plane;

$R_o$ is the radius of the billet;

A is an arbitary constant.

2. An extrusion die for extruding tubulars from metallic powder materials wherein the internal contour of the die conforms substantially to the formula:

$$\frac{1}{R^2} = \frac{(1 + Bx)}{(R_o^2 + R_m^2 BX)}$$

where R is the radius of the die contour at any given point x along the major axis of the die orifice from its entry plane;

$R_o$ is the outer radius of the billet;

$R_m$ is the radius of the mandrel; and

B is an arbitary constant.

* * * * *